US005655966A

United States Patent [19]

Werdin, Jr. et al.

[11] Patent Number: 5,655,966

[45] Date of Patent: Aug. 12, 1997

[54] METHOD AND APPARATUS FOR CASHLESS BARTOP GAMING SYSTEM OPERATION

[75] Inventors: Ernest R. Werdin, Jr., Corona Del Mar; Steven D. Lefler, Santa Ana; Stephen W. Punak, San Clemente, all of Calif.

[73] Assignee: Intergame, Irvine, Calif.

[21] Appl. No.: 512,354

[22] Filed: Aug. 7, 1995

[51] Int. Cl.[6] ..... A63F 9/22; A47B 25/00

[52] U.S. Cl. ..... 463/25; 463/29; 463/41; 463/46; 273/309

[58] Field of Search ..... 273/138 A, 309, 273/143 R, 138.1, 138.2; 463/20, 25, 41, 46, 29

[56] References Cited

U.S. PATENT DOCUMENTS

| | | | |
|---|---|---|---|
| 4,582,324 | 4/1986 | Koza et al. | 273/138 A |
| 4,630,821 | 12/1986 | Greenwald | 273/85 G |
| 4,669,730 | 6/1987 | Small | 273/138 A |
| 4,689,742 | 8/1987 | Troy et al. | 364/412 |
| 4,813,675 | 3/1989 | Greenwood | 273/138.2 |
| 4,815,741 | 3/1989 | Small | 273/138 A |
| 4,882,473 | 11/1989 | Bergeron et al. | 235/380 |
| 4,906,826 | 3/1990 | Spencer | 235/379 |
| 4,910,775 | 3/1990 | Yves et al. | 380/25 |
| 4,996,705 | 2/1991 | Entenmann et al. | 379/91 |
| 5,035,422 | 7/1991 | Berman | 273/439 |
| 5,038,022 | 8/1991 | Lucero | 235/380 |
| 5,179,517 | 1/1993 | Sarbin et al. | 364/410 |
| 5,283,734 | 2/1994 | Von Kohorn | 364/412 |
| 5,326,104 | 7/1994 | Pease et al. | 273/138.2 |
| 5,332,219 | 7/1994 | Marnell, II et al. | 273/138.2 |
| 5,393,057 | 2/1995 | Marnell, II | 273/85 CP |

FOREIGN PATENT DOCUMENTS

| | | | |
|---|---|---|---|
| 59-38876 | 8/1982 | Japan | 364/412 |
| 59-52373 | 9/1982 | Japan | 364/412 |
| WO81/01664 | 12/1979 | WIPO . | |

*Primary Examiner*—Benjamin H. Layno
*Attorney, Agent, or Firm*—Lyon & Lyon LLP

[57] ABSTRACT

A bartop gaming system comprising a plurality of player stations interconnected to a table server which is connected to a modem provides players with a cashless way of playing a gaming system. The bartop gaming system allows a player to use a financial institution credit card for gaming purposes, thereby eliminating the need for the player to carry cash, as well as the need for the gaming system to handle cash. The table server controls the individual player stations, and utilizes the modem for communicating with a financial institution for credit card limit verifications, as well as for collecting gaming system usage and information and relaying that information to a central processing station in a remote location. The player station comprises a flat screen color LCD video display which results in a thin profile player station housing unit, thereby enabling the installation of the bartop gaming system through the removal and replacement of an existing bartop with the thin profile player stations installed into a replacement bartop, rather than through the removal and replacement of the entire bar comprising the bartop and bar base.

28 Claims, 4 Drawing Sheets

METHOD AND APPARATUS FOR CASHLESS BARTOP GAMING SYSTEM OPERATION

FIELD OF THE INVENTION

This invention relates to a bartop gaming system, and more specifically to a bartop gaming system capable of replacing an existing bartop with minimal modifications, and capable of operating on a cashless basis.

BACKGROUND OF THE INVENTION

Existing bartop gaming systems suffer from several limitations. First, current systems are typically designed to accept only coins, paper currency, or prepaid cards. This requires that currency or prepaid cards be available to a player. With the prior art systems, a cashier, change person, change machine, or prepaid card vending terminal, was required to make available to the player the necessary currency or prepaid cards for gaming. Second, the gaming system, along with the associated change machines and vending terminals, must be constantly emptied of its cash, thereby increasing security and maintenance costs. Third, a drawback of prior art bartop gaming systems is that an entire bar (bartop and bar base) must be replaced to install a typical prior art bartop gaming system, due to its large size.

Therefore, a better bartop gaming system is needed to overcome all of the above mentioned drawbacks.

SUMMARY OF THE INVENTION

The bartop gaming system of the present invention for cashless operation provides a compact, thin profile, design which can be fitted into a specially designed bartop which serves as a replacement to the existing bartop without having to replace the bar base.

In a preferred embodiment, the bartop gaming system incorporates a unique cashless operating system which accepts major credit cards issued by financial institutions. Basically, a player swipes their credit card through the credit card magnetic strip reader located on a player station. The player station is networked to a table server, and the table server is connected to a modem. The player's credit card account information is transferred to a corresponding financial institution via a remote central processing location which is in communication with the modem, for verification of the player's available credit limit. The player will be allowed to request a credit on the player station up to the credit limit of their credit card, which has been verified through communication with the corresponding financial institution via modem.

By allowing a player to use a credit card, the likelihood of a person playing a game is increased, since most people carry a credit card. On the other hand, in prior art systems, players would have to purchase a prepaid card, get change, or have a pocket full of coins or acceptable bills.

Furthermore, by using credit cards, the bartop gaming system of the present invention is not burdened with the additional cost of security and maintenance for handling cash. In the prior art currency and prepaid card operated systems, a player's winnings are returned in cash. By implementing a cashless system based upon a credit card transaction, the bartop gaming system of the present invention does not pay a player's winnings in cash. All winnings in the bartop gaming system of the present invention are credited directly back to the player's credit card account, thereby eliminating the need for any currency to change hands. Any losses are deducted from the player's credit card account, and any remaining gaming credits not used are credited back to the player's account as an authorization credit.

This method of providing a cashless operating system enables the actual monetary transactions to be processed at a remote location, thus eliminating the need for physical cash to be moved at any time. Another advantage is that, by reducing the number of people handling physical cash, the chance for fraud or theft is likewise reduced.

As for the unique and beneficial structure of the bartop gaming system, the bartop gaming system of the present invention comprises a plurality of player stations and a table server residing in the immediate area of the bar. A typical bar comprises a bartop and a bar base. Each player station comprises a sheet of glass, a video display, an on-board computer, a power supply, a credit card magnetic strip reader, a button control pad, a receipt printer, and a network connector conduit comprising cables and wires for communicating with the table server and for receiving power. The table server is connected to a modem for communicating with a financial institution, and for collecting gaming system usage and information and relaying that information to a central processing station in a remote location.

In a preferred embodiment, each player station is approximately 24"×18"×4" in dimension and is a completely self-contained unit which only needs to be plugged into a docking mechanism designed into a specially designed bartop, in order to begin operation of the player station.

The bartop gaming system comprises a sheet of glass through which a flat screen video display is visible. As a player sits down at a chair or stool in front of a bar, the player is able to view the video display through the glass surface of the player station, which is positioned within a replacement bartop. Ergonomically located in front or on each side of every player position are a plurality of buttons for game control. Located preferably beneath the front edge of the bartop, and accessible by the player, are a credit card magnetic strip reader and a catch bowl for printed receipts.

The player stations are linked to each other and to the table server via the computer network cables in the network connector conduit. The dimensions of a bartop replacement can be custom designed to receive a predetermined number of player stations and to fit atop a specific bar base. By utilizing flat screen technology in the video display, the bartop gaming system of the present invention can be installed in the place of an existing bartop, without having to remove and replace the bar base.

The table server is typically stored in a separate enclosure not visible to a player. The table server has a control center which comprises a computer having a memory, as well as network and data communications hardware. The table server controls the various player stations and transmits/receives information such as accounting and credit card verification via the modem, which can be connected to an outside telephone line, in the usual manner, for this purpose.

After power is applied, the table server initializes communication with the various player stations. When initialization is successful, software is downloaded into each of the player stations. The player stations then utilize this software to initialize their peripheral components including the credit card magnetic strip reader, receipt printer, and multiple button control pad. If initialization of the peripheral components fails due to a defective component, a ROM/BIOS generated message is displayed on the video display indicating that that particular gaming station is out of order, along with an error code. A message is also returned to the table server notifying the server that service is required. A defective player station can be easily removed from the replacement bartop and corresponding docking mechanism, so that a new player station can be installed in its place.

If initialization of the peripheral components is successful, the gambling software begins execution. A demonstration, as well as commercial advertising material, is constantly displayed to attract customer attention, as well as generate revenue from paying advertisers. When any of the control buttons is pressed, a message is displayed prompting the player to insert their credit card to begin play.

It is therefore an object of the present invention to provide an improved bartop gaming system.

It is a further object of the invention to provide a bartop gaming system wherein all transactions are cashless.

An additional object of the invention is to allow centralized processing at a remote location of all accounting information from all interconnected gaming systems via a modem link.

It is yet another object of the present invention to provide a bartop gaming system wherein only the bartop, rather than the bartop and bar base, needs to be replaced for installation into an existing bar.

Further objects and advantages of the present invention will become apparent from a consideration of the drawings and ensuing description.

DETAILED DESCRIPTION OF A PREFERRED EMBODIMENT

Figure 1:
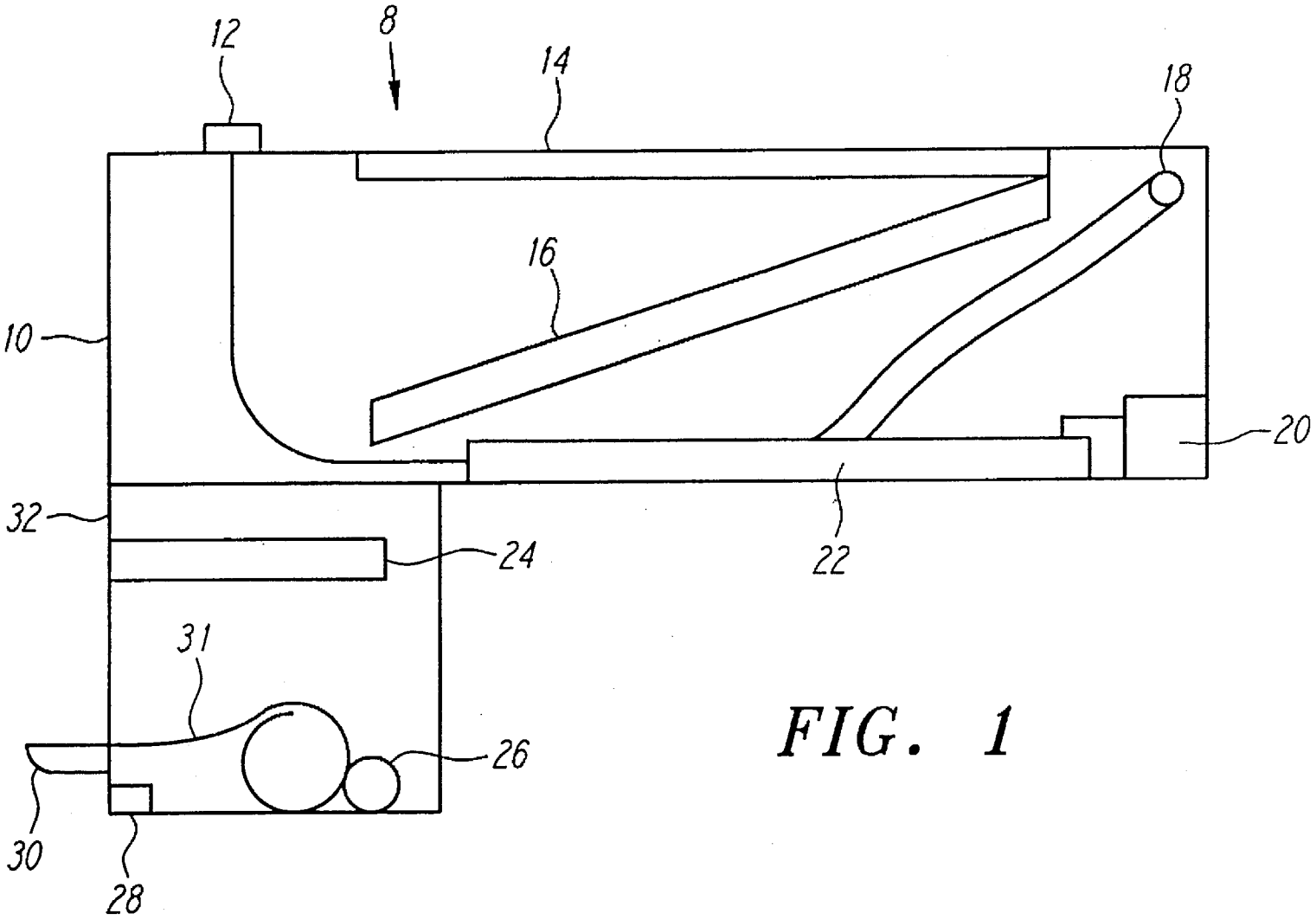
FIG. 1 is a side cutaway view of a player station portion of a bartop gaming system.
Figure 3:
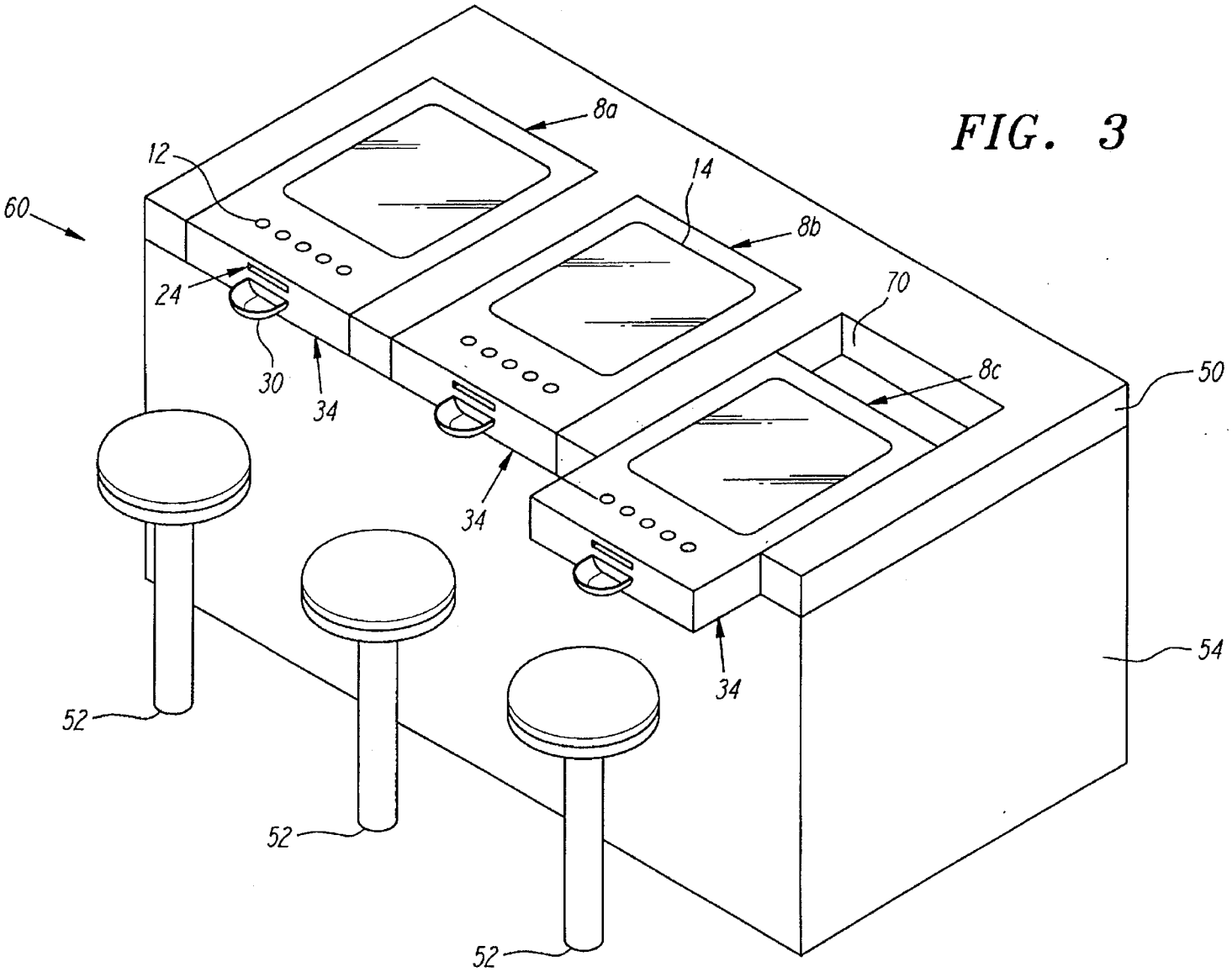
FIG. 3 is a perspective view of a bar comprising three player stations in a replacement bartop which can be installed onto a pre-existing bar base.
Figure 4:
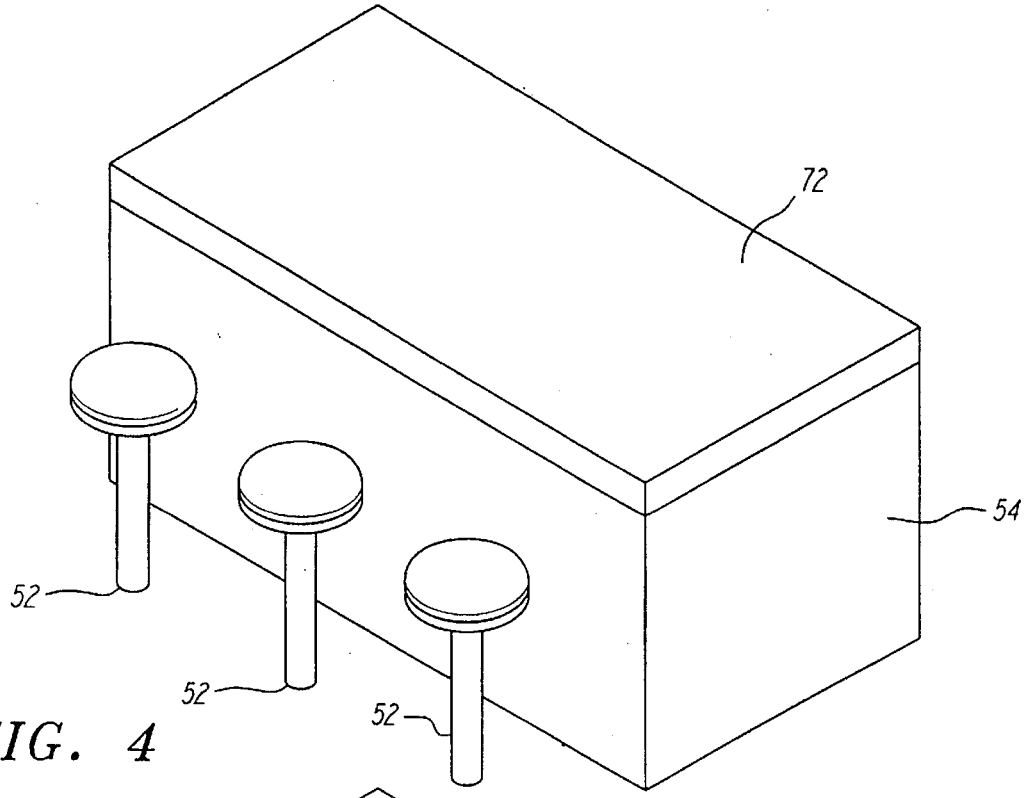
FIG. 4 is a perspective view of a pre-existing bartop attached to a bar base.
Figure 5:
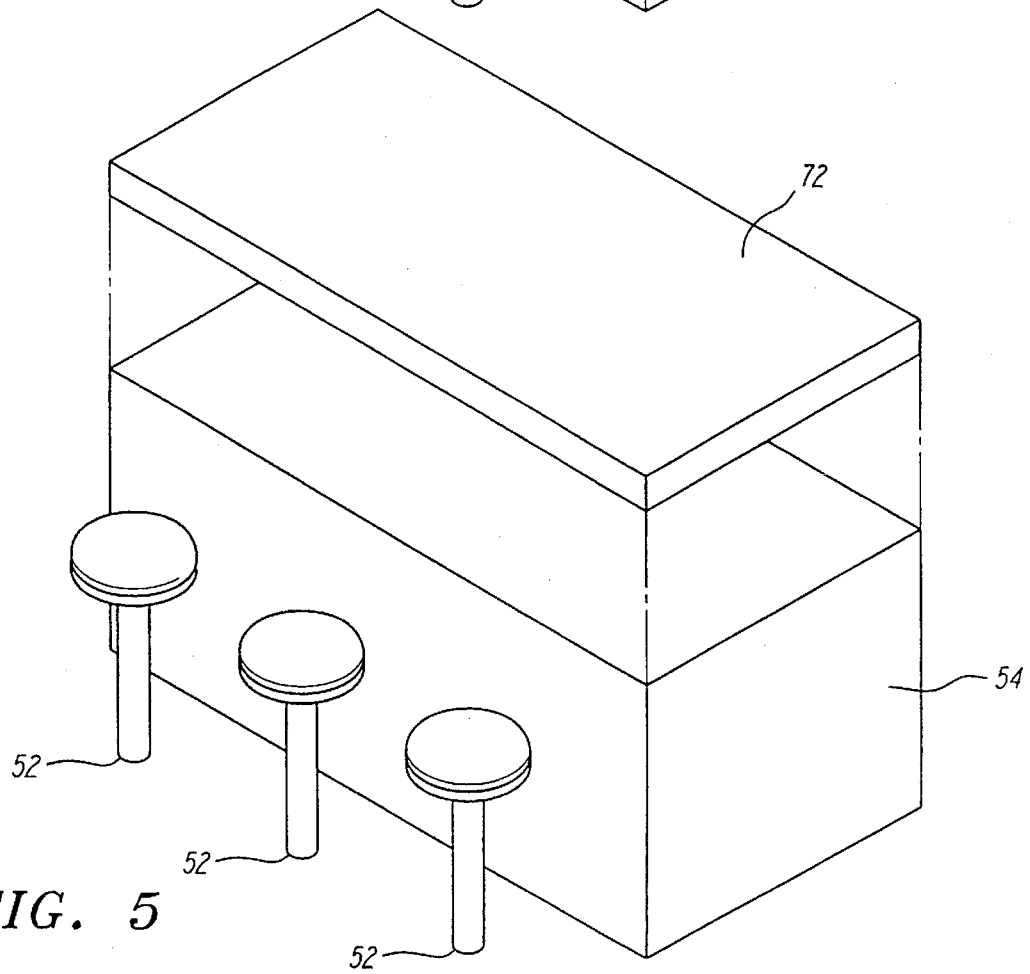
FIG. 5 is a perspective view of a pre-existing bartop removed from the bar base.

FIG. 1 is a side cutaway view of a player station 8. An upper housing 10 of the player station 8 is preferably designed to fit into a docking mechanism (not shown) of a replacement bartop 50 (as shown in FIG. 3). Upon removal of a standard bartop 72 (as shown in FIGS. 4 and 5) the replacement bartop 50 is designed to fit exactly into a pre-defined space previously occupied by said standard bartop 72. The upper housing 10 provides an opening for the placement of a sheet of glass 14 (or other clear material such as plexiglass) which serves as a viewing window. The glass 14 allows a player to see a video display 16.

In a preferred embodiment, the video display 16 is a flat-screen active-matrix color LCD display, as is commonly seen and used today on portable computer systems. By using flat screen technology for the video display 16, the bartop gaming system of the present invention provides the player station 8 portion of the bartop gaming system with a thin profile. By providing a thin profile, installation of the player station 8 requires only that an existing bartop 72 be replaced, rather than the entire bar comprising the existing bartop and the bar base 54 (as shown in FIGS. 4 and 5).

The player station 8 utilizes a control center comprising a computer 22 having a microprocessor (not shown) to receive input from the player via a control button pad 12, and to receive credit card information from the player via a credit card magnetic strip reader 24. Visual output is provided to the player via the video display 16, and receipts are provided to the player via a receipt printer 26. The receipts are deposited into a catch bowl 30 which is conveniently attached to a lower housing 32. The magnetic strip reader 24 and receipt printer 26 are contained in the lower housing 32, and a lock 28 can be placed on the lower housing to allow service personnel to access and change the receipt printer paper 31.

Figure 2:
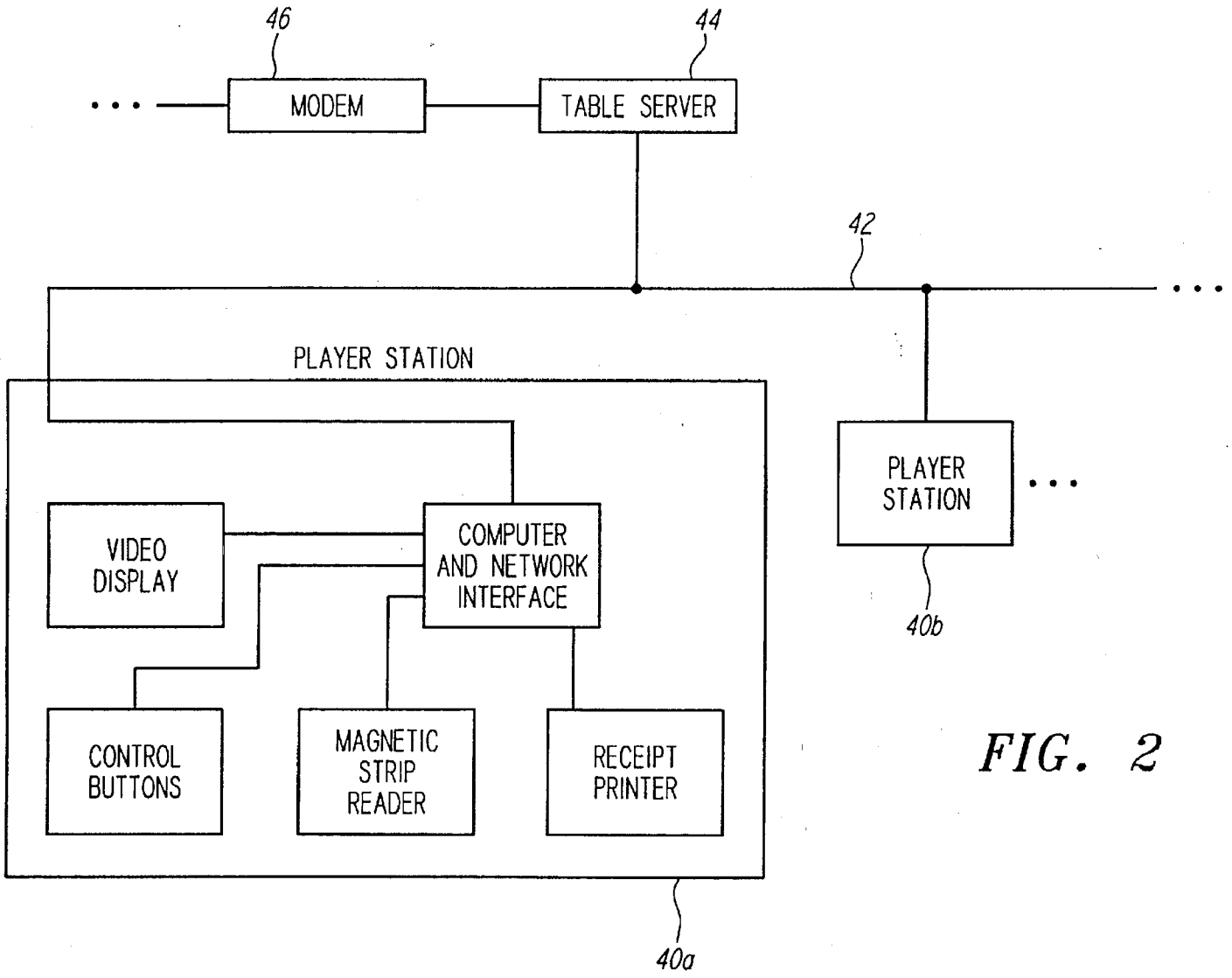
FIG. 2 is a block diagram depicting the interconnection of a plurality of player stations, a table server, and a modem.

The player station 8 unit is powered via a power supply 20, which in turn receives its power through a power cable (not shown) running through a network connector conduit 18. The power cable, along with computer network cables 42 (as shown in FIG. 2), and any other necessary wiring can be run through this conduit 18 to an external location. The interface between each player station 8 and a table server 44 (as shown in FIG. 2) is preferably designed as a docking mechanism (not shown) in the replacement bartop 50 (as shown in FIG. 3) such that the bartop gaming system is capable of connecting to a power line (not shown) and to the table server 44 (as shown in FIG. 2) once the bartop gaming system is properly installed onto the pre-existing bar base 54 (as shown in FIG. 3).

The player station 8 is sealed to prevent spilled liquids from entering into the upper housing 10 which contains electrical components. The control button pad 12 consists of a plurality of buttons of the type commonly found on video game systems, and are also sealed to prevent spilled liquids from leaking into the upper housing 10.

FIG. 2 is a block diagram illustrating the interconnection of a bartop gaming system of the present invention comprising the table server 44, a plurality of player stations 40 (40*a*, 40*b*, 40*c*, etc.) and a modem 46. Each player station 40 is linked to every other player station 40, as well as to the table server 44 via computer network cables 42. Connecting electrical equipment into a communicating network is known and understood by a person of ordinary skill in the computer art, and is not relevant to the understanding of the present invention, and therefore, details of these interconnections are not discussed in further detail.

The table server 44 is connected to the modem 46 which is typically connected to a telephone line (not shown). In a preferred embodiment, the table server 44 tracks accounting information from the various player stations 40 and sends this information to a remote data collection station (not shown) via modem 46 at a regular interval. In addition, the modem 46 provides communication between the bartop gaming system and various financial institutions.

FIG. 3 is a perspective view of a bar 60 comprising the bar base 54 and the replacement bartop 50. The replacement bartop 50 has three player stations 8*a*, 8*b* and 8*c*, installed into specially designed receptacles 70 for receiving playing stations 8, with the docking mechanism interface between the player stations 8 and the network connector conduit 18 (as shown in FIG. 1). Typically, bar stools 52 are placed in front of each player station 8*a*, 8*b* and 8*c*. In the preferred embodiment shown in FIG. 3, the player station 8 is housed in a single housing unit 34 which incorporates the components in the upper housing 10 (as shown in FIG. 1) and the components in the lower housing 32 (as shown in FIG. 1). Furthermore, in this embodiment, the adjacent player stations 8 are also incorporated into the single housing unit 34 type of housing. The video displays 16 (as shown in FIG. 1) are visible to the player through the sheet of glass 14. The player may initiate a game by inserting their credit card into the credit card magnetic strip reader 24. Play is controlled through the use of buttons on the control button pad 12. At the end of the game, a credit card receipt is printed on receipt printer paper 31 (as shown in FIG. 1) and is deposited into the catch bowl 30, so that the player has a printed transaction record of their gaming session.

While the above description contains many specificities, these should not be construed as limitations on the scope of the invention, but rather as an exemplification of preferred embodiments thereof. Many other variations are possible. For example, the components located in the upper housing and the components located in the lower housing can be placed into a single housing, if the dimensions of such a design are best suited to replace an existing bartop. Furthermore, the video display can incorporate any display technology which provides acceptable resolution in a thin profile player station.

What is claimed is:

1. A bartop gaming system comprising at least one player station, a replacement bartop having at least one receptacle for receiving said player station, a table server capable of being in electrical communication with said player station, said player station comprising a housing having an upper surface, a lower surface, and side surfaces, a sheet of clear material integral to said upper surface for providing a viewing window into said housing, a flat screen video display positioned in said housing to be visible through said sheet of clear material, a control button pad located externally to said housing on said upper surface, a control center having a microprocessor capable of being in electrical communication with said video display and said control button pad, and said player station capable of being contained in a thin profile housing unit through the use of said flat screen video display, thereby enabling said player station to be installed into said replacement bartop designed to replace a pre-existing bartop while leaving a bar base intact.

2. The bartop gaming system of claim 1 further comprising a modem capable of being in electrical communication with said table server and a telephone line.

3. The bartop gaming system of claim 1 further comprising a network connector conduit interconnecting said player station and said table server for routing power and computer network cables between said player station and said table server.

4. The bartop gaming system of claim 1 further comprising a power supply capable of receiving power from a power cable in said network connector conduit, and capable of being in electrical communication with said flat screen video display, said control center, and said control button pad.

5. The bartop gaming system of claim 1 further comprising a credit card magnetic strip reader capable of being in electrical communication with said control center and said power supply.

6. The bartop gaming system of claim 1 further comprising a receipt printer located in said housing and a catch bowl attached externally to said housing.

7. The bartop gaming system of claim 1 further comprising a receipt printer located in said housing and a catch bowl attached to said housing.

8. A method of installing a bartop gaming system comprising the following steps:

removing a pre-existing bartop portion of a bar while leaving a remaining bar base portion intact, placing a replacement bartop having at least one receptacle for receiving a player station on said bar base, installing a network connector conduit from a table server to a player station via said replacement bartop, and installing said player station into said replacement bartop, said player station being in communication with said network connector conduit.

9. The method of claim 8, wherein said network connector conduit interconnects said player station and said table server by routing power and computer network cables between said player station and said table server.

10. A bartop gaming system comprising at least one player station, a replacement bartop having at least one receptacle for receiving said player station, a table server capable of being in electrical communication with said player station, said player station comprising a housing having an upper surface, a lower surface, and side surfaces, a sheet of clear material integral to said upper surface for providing a viewing window into said housing, a flat screen video display positioned in said housing to be visible through said sheet of clear material, a player input mechanism, a control center having a microprocessor capable of being in communication with said video display and said player input mechanism, and said player station capable of being contained in a thin profile housing unit through the use of said flat screen video display, thereby enabling said player station to be installed into said replacement bartop designed to replace a pre-existing bartop while leaving a bar base intact.

11. The bartop gaming system of claim 10 further comprising a modem capable of being in electrical communication with said table server and a telephone line.

12. The bartop gaming system of claim 10 further comprising a network connector conduit interconnecting said player station and said table server for routing power and computer network cables between said player station and said table server.

13. The bartop gaming system of claim 10 further comprising a power supply capable of receiving power from a power cable in said network connector conduit, and capable of being in electrical communication with said flat screen video display, said control center, and said player input mechanism.

14. The bartop gaming system of claim 10 further comprising a credit card magnetic strip reader capable of being in electrical communication with said control center and said power supply.

15. The bartop gaming system of claim 10 further comprising a receipt printer located in said housing and a catch bowl attached to said housing.

16. The bartop gaming system of claim 10 wherein said player input mechanism comprises a control button pad located externally to said upper housing.

17. The bartop gaming system of claim 10 wherein said player input mechanism comprises a viewing window with a touch-screen sensor.

18. A bartop gaming system comprising at least one player station, a replacement bartop having at least one receptacle for receiving said player station, said player station comprising a housing having an upper surface, a lower surface, and side surfaces, a sheet of clear material integral to said upper surface for providing a viewing window into said housing, a flat screen video display positioned in said housing to be visible through said sheet of clear material, a control button pad located externally to said housing on said upper surface, a control center having a microprocessor capable of being in communication with said video display and said control button pad, and said player station capable of being contained in a thin profile housing unit through the use of said flat screen video display, thereby enabling said player station to be installed into said replacement bartop designed to replace a pre-existing bartop while leaving a bar base intact.

19. The bartop gaming system of claim 18 further comprising a modem capable of being in electrical communication with said player station and a telephone line.

20. The bartop gaming system of claim 18 further comprising a power supply capable of receiving power from a power cable, and capable of being in electrical communication with said flat screen video display, said control center, and said control button pad.

21. The bartop gaming system of claim 18 further comprising a credit card magnetic strip reader capable of being in electrical communication with said control center and said power supply.

22. The bartop gaming system of claim 18 further comprising a receipt printer located in said housing and a catch bowl attached to said housing.

23. A bartop gaming system comprising at least one player station, a replacement bartop having at least one receptacle for receiving said player station, said player station comprising a housing having an upper surface, a lower surface, and side surfaces, a sheet of clear material integral to said upper surface for providing a viewing window into said housing, a flat screen video display positioned in said housing to be visible through said sheet of clear material, a player input, a control center having a microprocessor capable of being in communication with said video display and said player input, and said player station capable of being contained in a thin profile housing unit through the use of said flat screen video display, thereby enabling said player station to be installed into said replacement bartop designed to replace a pre-existing bartop while leaving a bar base intact.

24. The bartop gaming system of claim 23 further comprising a modem capable of being in electrical communication with said player station and a telephone line.

25. The bartop gaming system of claim 23 further comprising a power supply capable of receiving power from a power cable, and capable of being in electrical communication with said flat screen video display, said control center, and said player input.

26. The bartop gaming system of claim 23 further comprising a credit card magnetic strip reader capable of being in electrical communication with said control center and said power supply.

27. The bartop gaming system of claim 23 further comprising a receipt printer located in said housing and a catch bowl attached to said housing.

28. The bartop gaming system of claim 23 wherein said player input comprises a control button pad located externally to said upper housing.

* * * * *